US008955414B2

(12) United States Patent
Merrick

(10) Patent No.: US 8,955,414 B2
(45) Date of Patent: Feb. 17, 2015

(54) NUT REMOVAL TOOL

(71) Applicant: Tool Tech, LLC, Scottsdale, AZ (US)

(72) Inventor: Jake Merrick, Hinton, OK (US)

(73) Assignee: ToolTech, LLC, Phoenix, AZ (US)

( * ) Notice: Subject to any disclaimer, the term of this patent is extended or adjusted under 35 U.S.C. 154(b) by 171 days.

(21) Appl. No.: 13/767,727

(22) Filed: Feb. 14, 2013

(65) Prior Publication Data

US 2014/0224074 A1 Aug. 14, 2014

(51) Int. Cl.
*B25B 17/00* (2006.01)
*B25B 13/50* (2006.01)

(52) U.S. Cl.
CPC ..... *B25B 13/50* (2013.01)
USPC ..... 81/52; 81/53.2; 81/57.18

(58) Field of Classification Search
USPC ..... 81/53.2, 57.18, 57.34
See application file for complete search history.

(56) References Cited

U.S. PATENT DOCUMENTS

| | | | | | |
|---|---|---|---|---|---|
| 2,580,247 | A | * | 12/1951 | Secondi et al. | 81/53.2 |
| 2,592,037 | A | * | 4/1952 | Keiser | 81/53.2 |
| 4,513,643 | A | * | 4/1985 | McKean | 81/53.2 |
| 4,590,826 | A | * | 5/1986 | McKean | 81/53.2 |
| 4,856,386 | A | * | 8/1989 | Rodriguez | 81/90.2 |
| 4,947,712 | A | | 8/1990 | Brosnan | |
| 5,251,515 | A | * | 10/1993 | Merrick | 81/53.2 |
| 5,315,902 | A | * | 5/1994 | Ragland et al. | 81/53.2 |
| 2008/0016987 | A1 | | 1/2008 | Schultz | |
| 2009/0151520 | A1 | | 6/2009 | Wang | |

FOREIGN PATENT DOCUMENTS

| | | | |
|---|---|---|---|
| JP | 07052057 | A | 2/1995 |
| KR | 1020020000314 | A | 1/2002 |

OTHER PUBLICATIONS

International Search Report with Written Opinion issued in related PCT Application No. PCT/US2014/016467, dated May 20, 2014, 9 pages.

* cited by examiner

*Primary Examiner* — Monica Carter
*Assistant Examiner* — Danny Hong
(74) *Attorney, Agent, or Firm* — Bracewell & Giuliani LLP

(57) ABSTRACT

An apparatus for removing a nut is described. The apparatus includes a housing, a cage, and a canted coil spring. The housing has a top surface, an interior sidewall, and a bottom surface. The interior sidewall defines an orifice that extends from the top surface to a lip. The interior sidewall includes a three-lobed cam and a groove. Each lobe has a lobe center line, a counterclockwise cam inner surface on one side of the lobe center line, and a clockwise cam inner surface on the opposite side of the lobe center line. The canted coil spring is received by the groove of the interior sidewall and the groove of the cage. The canted coil spring rotatably couples the cage to the housing. During nut removal, the housing rotates counterclockwise relative to the cage. The cage rotates counterclockwise to engage the nut, and the cage interfaces with the interior sidewall.

30 Claims, 8 Drawing Sheets

NUT REMOVAL TOOL

CROSS-REFERENCE

The present patent application is related to application Ser. No. 13/767,704 entitled STUD REMOVAL TOOL filed on Feb. 14, 2013; and application FLIP SOCKET NUT REMOVAL TOOL having application Ser. No. 13/767,746 filed on Feb. 14, 2013; and application SOCKET FASTENER REMOVAL TOOL having application Ser. No. 13/767,771 filed on Feb. 14, 2013; and application DUTCHMAN FASTENER REMOVAL TOOL having application Ser. No. 13/767,758 filed on Feb. 14, 2013.

FIELD

The invention is a nut removal tool. More particularly, this invention relates to a tool for the removal of rusted or broken nuts from a large mating bolt.

BACKGROUND

A nut is a type of fastener with a threaded hole that interfaces with a mating bolt. The nut and mating bolt are kept together by a combination of thread friction, a slight stretch of the bolt, and compression of the parts. The most common shape for a nut fastener is hexagonal because six sides gives a good granularity of angles for a tool to approach from, but corners are vulnerable to being rounded off.

Nuts are traditionally removed using hand wrenches or nut removers, applying force to a side face or faces of a nut to cause its rotation. However, where the side faces of the nut have been stripped or damaged, where the nut has been corroded, or where the head of the nut has been removed altogether, it is very difficult and time consuming to remove such nuts.

A further complication of nut removal using manual tools is that, where the nut is very large, such as those used in oil production, manual removal of such damaged nuts presents danger to the operator, or removal is impossible because of the degree of torque required for removal.

One type of device accomplishes nut removal by sawing off the nut, or by using a blow torch to cut the nut off of the stud. However, these methods of nut removal result in damage to the nut or the fixture. One solution is to use with devices which either drill the nut, or cut into the nut, so that torque can be applied to the nut for removal. However, these devices also result in further stripping and rounding of the nut.

Devices for the removal of large nuts using an air impact tool exist; however, in one such device, a cartridge having many small parts is used to apply torque to the damaged nut and these multiple small parts of the cartridge, such as multiple helical springs, studs and screws holding gripping jaws together, are prone to breakage.

A further complication is that cartridges and other parts are held within a cylindrical housing using a retaining ring or clip. The retaining ring or clip is prone to breakage, resulting in a damaged and useless tool.

Another complication of nut removal using a hand-powered tool is side loading, or the mechanical binding of threaded surfaces against each other. When side loading occurs, heat builds up due to friction between the threaded surfaces, creating a gall which is carried through the housing, tearing out the threads, and impeding nut removal.

Yet another complication is "chattering," where the tool does not perfectly conform to the size of the fastener. When rotative force is applied using an air impact tool, the removing tool "chatters" over the damaged corners of the fastener, further stripping the fastener or damaging the tool interface with the fastener, and causing 'radii' to form on the end of the tool.

A further problem is presented with a single device for nut removal, because the device is limited in the size of nuts which can be removed with a single tool; that is, different sized nuts cannot be removed with the same tool because the nut heads cannot fit within the tool.

The use of a set of tools having a multiplicity of sizes to conform to different nut head sizes exists which proposes to solve this problem of imperfect conformance between removal tool and nut size. However, regardless of the size, the result is chattering from an imperfect size conformance; thus, stripping of the nut thread occurs.

Further, the use of a set of tools having a multiplicity of sizes to conform to nut sizes presents another complication. If there exists a multiplicity of removal tool sizes in a set, the loss of one of the tools results in a useless tool set.

While the use of an air impact tool may remove much of the operator danger associated with hand wrenches, the use of an air impact tool presents a further problem. That is, the air impact tool, itself, creates a shock upon impact with the nut. While a device may use a helical spring to absorb such impact shock, the device does not simultaneously retain a grip upon the nut to be removed. While such a device may be beneficial for smaller nuts, a tool used in removing large nuts should retain a grip upon the nut after removal in order to prevent injury to the operator from dropping the nut.

A further complication of some devices is that these ridged teeth on the gripping surface of the jaws which strip the nut heads having a set number of faces, i.e. a hexagonal nut head.

It would thus be desirable to have a nut removal tool that conforms to the size and shape of a multiplicity of nut heads, where the jaws of the tool comprise one piece, rather than a multiplicity of smaller pieces which can be easily lost or damaged, and where the jaws are retained within the housing through a shock-absorbing canted coil spring.

SUMMARY

An apparatus for removing a nut is described. The apparatus includes a housing, a cage, and a canted coil spring. The housing has a top surface, an interior sidewall, and a bottom surface. The interior sidewall defines an orifice that extends from the top surface to a lip. The interior sidewall includes a three-lobed cam and a groove. Each lobe has a lobe center line, a counterclockwise cam inner surface on one side of the lobe center line, and a clockwise cam inner surface on the opposite side of the lobe center line. The groove is disposed between the top surface and the lip.

The cage has a top surface, a bottom portion ending in a tapered terminus, and a groove disposed in the bottom portion between the top surface and the tapered terminus. The cage includes three jaws. Each jaw includes a jaw outer cam surface, a jaw centerline, and a jaw inner cam surface. The jaw outer cam surface interfaces with the cam inner surface corresponding to the interior sidewall. The jaw inner cam surface interfaces with the head of the nut. The jaw inner cam surface includes a counterclockwise cam inner surface on one side of the jaw centerline, and a clockwise cam inner surface on the opposite side of the jaw centerline.

The canted coil spring is received by the groove of the interior sidewall and the groove of the cage. The canted coil spring rotatably couples the cage to the housing. During nut removal, the housing rotates counterclockwise relative to the cage. The cage rotates counterclockwise to engage the nut, and the cage interfaces with the interior sidewall. The canted coil spring operates within a constant deflection range, when an axial load is applied by the housing and the cage.

In one embodiment, the canted coil spring has the coils canted in a clockwise direction. In another embodiment, the canted coil spring has the coils canted in a counterclockwise direction.

In the illustrative embodiment, the lobe center line for each lobe is 120° apart, each lobe occupies a 120° arc, the counterclockwise cam interface has a 60° arc and the clockwise cam interface has a 60° arc. In the illustrative embodiment, each lobe is substantially semi-circular.

In a further illustrative embodiment, the jaw centerlines for each jaw are 120° apart, and each jaw outer cam surface occupies a 60° arc.

In the illustrative embodiment, the jaw outer cam surface is configured to engage with the counterclockwise cam interface when a counterclockwise force is applied to the housing. In a further embodiment, the jaw outer cam surface is configured to engage with the clockwise cam interface when a clockwise force is applied to the housing.

In the illustrative embodiment, the jaw inner counterclockwise cam surface is configured to engage with three surfaces of the head of a hexagonal nut when a counterclockwise force is applied to the jaw outer cam surface. In a further embodiment, the jaw inner clockwise cam surface is configured to engage with three surfaces of the head of a hexagonal nut when a clockwise force is applied to the jaw outer cam surface.

In another illustrative embodiment, an elastomeric or elastic component is configured to join the plurality of jaws.

In the illustrative embodiment, the bottom end interfaces with an impact rotary tool that can oscillate between applying a counterclockwise force and a clockwise force. Additionally, the bottom end further comprises a slot that receives a pin that is inserted within the slot when the housing interfaces with the impact rotary tool.

DESCRIPTION

Figure 1A:
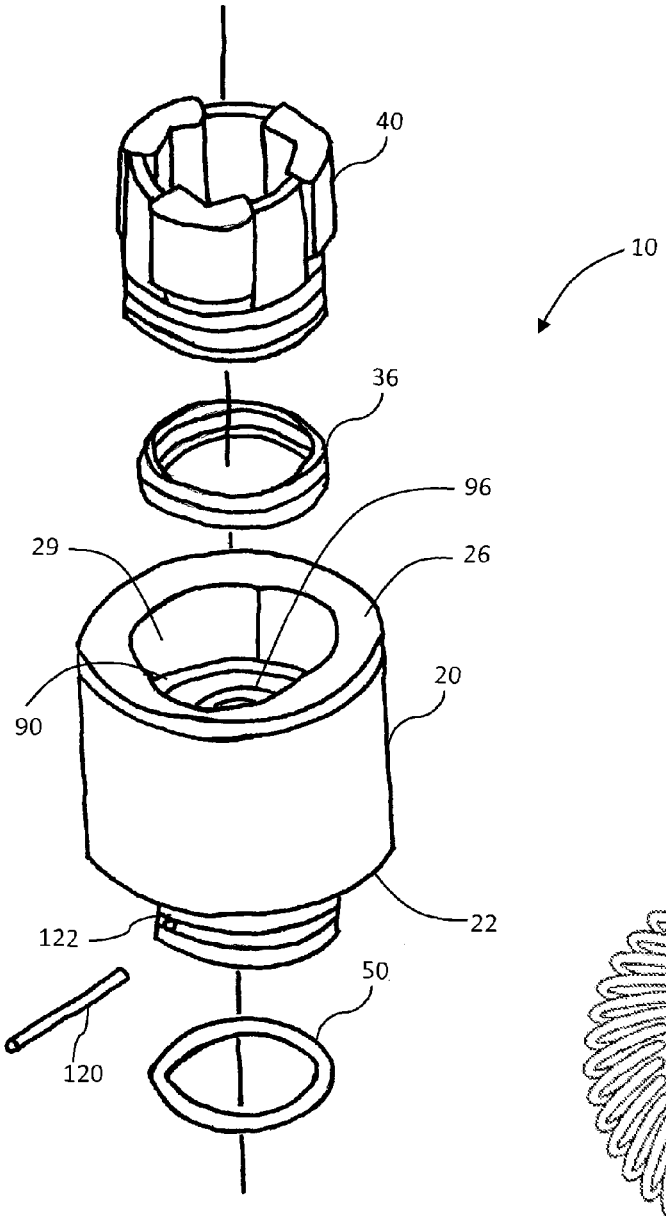
FIG. 1A shows an isometric view of an illustrative nut removal tool.

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the apparatus and systems described herein may vary as to configuration and as to details. Additionally, the methods may vary as to details, order of the actions, or other variations without departing from the illustrative method disclosed herein.

It is to be understood that the detailed description of illustrative embodiments provided for illustrative purposes. The scope of the claims is not limited to these specific embodiments or examples. Various structural limitations, elements, details, and uses can differ from those just described, or be expanded on or implemented using technologies not yet commercially viable, and yet still be within the inventive concepts of the present disclosure. The scope of the invention is determined by the following claims and their legal equivalents.

The nut removal tool described herein is used for the removal of a nut from a bolt. Generally, the removal of the nut employs an impact wrench tool. Alternatively, other tools that provide needed torque may also be used. By way of example and not of limitation, the nut removal tool described herein may be used to remove nuts that are deployed in oil production or power generation.

For the purposes of this patent, the terms "fastener" and "nut" will be used interchangeably. A nut is a fastening device that is typically a square or hexagonal block, usually of metal, with a hole in the centre having internal female threads that fit on the male threads of an associated with a complementary bolt, screw or stud. A bolt, screw or stud with a nut is widely used for fastening machine and structural components. An illustrative bolt includes a head, a body and threads. An illustrative hexagonal nut with female threads interfaces with the male threads of the illustrative bolt. A stud has all its length threaded with male threads and may interface with a threaded aperture of a fixture on one end and a nut on the opposite end.

In addition to the standard square and hexagonal nuts, there are many special types such as a slotted or castellated nut. In the illustrative embodiment presented herein, a hexagonal nut is used; however, it shall be appreciated by those of ordinary skill in the art that other nut geometries may be configured to interface with the nut removal tool removal described herein.

For purposes of this patent, the terms "cage" and "cartridge" will be used interchangeably. The cage "floats" or rests on an illustrative canted coiled spring which is used to engage the cage with a housing that receives a counterclockwise force.

The canted coil spring is presented in the illustrative spring technology that allows the cage to rotate freely, while ensuring that the cage does not slide out of the housing. Alternatively, a knitted spring tube may also be used instead of the canted coil spring. The canted coil spring and the knitted spring tube may also be referred to as a seal preload device. Other spring technologies may also be used that allow the cage (which grips the nut) and the housing (which interfaces with the cage) to rotate freely in either a counterclockwise or counterclockwise direction, while at the same time ensuring that the cage does not slide out of the housing.

Additionally, the illustrative embodiment presented herein includes a three-lobed cam along the interior sidewall of the housing, as described in further detail below. The three-lobed cam is configured to interface with a cage, which interfaces with a nut. Each lobe of the illustrative three-lobed cam occupies a 120° arc and has a lobe centerline, a counterclockwise cam inner surface on one side of the lobe centerline, and a clockwise cam inner surface on the opposite side of the lobe centerline.

Generally, a counterclockwise force (to loosen the nut) is applied to the housing for nut removal; this counterclockwise force is transferred to the cage when the cage interfaces with the counterclockwise cam inner surface. There may be instances when nut removal requires the application of a clockwise force (tightening the nut), and then reverting back to the counterclockwise force.

The three-lobed cam described below is provided for illustrative purposes only. Alternatively, other lobed cam assemblies may also be used such as a two-lobed cam, a four-lobed cam, five-lobed cam, etc. The number of lobes and configuration of each lobe will depend on the particular application.

Referring to FIG. 1A there is shown an illustrative nut removal tool 10. The nut removal tool includes a housing 20. The housing may be composed of a material having the appropriate tool steel grade or stainless steel grade. The housing may be manufactured by machining, utilizing a mold, or other such manufacturing techniques that are specific to tool manufacturing. The housing includes a bottom surface 22 and a top surface 26. The housing 20 may interface with a rotary tool such as an impact wrench (not shown).

By way of example and not of limitation, the housing 20 is constructed of heat treated S7 steel that measures 52-54 on the Rockwell C scale, as measured with a Hardness Tester, such as that described in U.S. Pat. No. 1,294,171, "HARDNESS TESTER," Hugh M. Rockwell and Stanley P. Rockwell, issued Feb. 11, 1919. S7 steel is a shock-resistant, air-hardening steel used for tools, and which is designed for high impact resistance at relatively high hardness in order to withstand chipping and breaking. In an alternative embodiment, H-13 steel is used, measuring 44-46 on the Rockwell C scale. Other alloys may also be used. Steels used are not plated or coated, other than surface treatment to produce a black oxide finish for corrosion resistance.

The top surface 26 includes an orifice defined by interior sidewall 29 that extends to the lip 90. The interior sidewall 29 includes a plurality of cam inner surfaces along the interior sidewall 29.

Figure 1B:
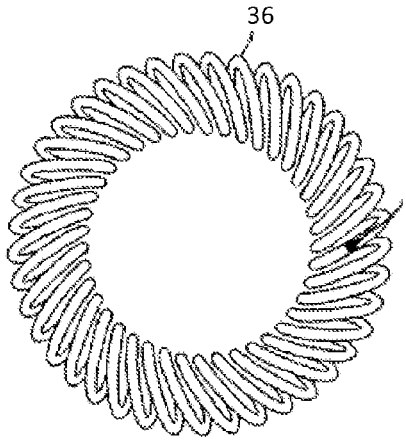
FIG. 1B shows an exploded view of a canted coil spring.

A canted coil spring 36 rests within a groove 96 in the interior sidewall 29. FIG. 1B presents an exploded view of the canted coil spring 36. More generally, the canted coil spring may be referred to as a seal preload device. For example, another illustrative seal preload device is a knitted spring tube, as shown in FIG. 2D. The canted coil spring 36 engages the cage 40 to the housing 20, while enabling the cage to "float" on the housing.

As shown in FIG. 1A, the canted coil spring 36 and the housing 20 are configured to receive the cage 40. The housing 20 is shown in further detail in FIGS. 3A, 3B, 4 and 7 presented hereinafter. The cage 40 is described in further detail at FIGS. 5-6. The illustrative bottom surface 22 of the housing 20 receives an illustrative O-ring 50, which is configured to interface with an illustrative impact wrench (not shown). Alternatively, the O-ring 50 may be replaced with a second canted coil spring. Further detail regarding the bottom surface 22 of the housing 20 is presented in FIG. 3B, which shows a bottom view of the bottom surface 22.

In the illustrative embodiment, the bottom surface 22 is configured to receive an impact rotary tool. The housing 20 may further include a slot 120 configured to receive a pin 122 that is inserted within the slot 120 when the housing 20 is configured to interface with a rotary tool. For a rotary tool having a one inch square drive or greater, the pin 120 is used to secure tool within the housing 20 and the O-ring 50 secures the pin 120.

More generally, the nut removal tool 10 includes a fastening component with a biasing element that is configured to allow the cage 40 and the housing 20 to rotate freely in a counterclockwise or clockwise direction, and also enables the cage 40 to stay within the housing 20 during the stud removal operations. The illustrative fastening component with the biasing element presented herein includes seal preload device such as a canted coil spring. An alternative biasing element may include a clip (shown in FIG. 9) or a retaining clip (shown in FIG. 10).

Figure 2A:
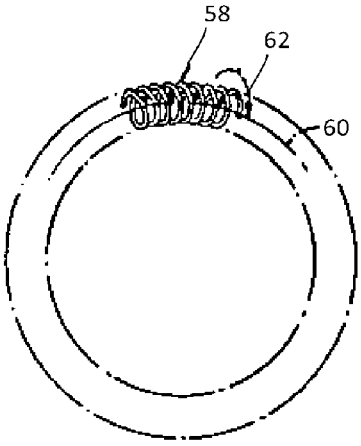
FIG. 2A shows a canted coil spring wound in a clockwise direction about the coil centerline.
Figure 2B:
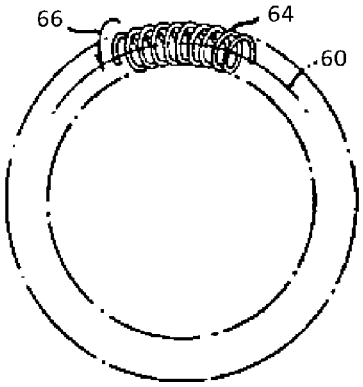
FIG. 2B shows a canted coil spring wound in a counterclockwise direction about the coil centerline.

The illustrative embodiment may include one of two types of canted coil springs, as shown in FIGS. 2A and 2B. The first type of canted coil spring 58 presented in FIG. 2A has the coils wound in a clockwise direction about the coil centerline 60 as indicated by arrow 62. The second type of canted coil spring 64 is shown in FIG. 2B and has the coils wound in a counterclockwise direction about the coil centerline 60 as indicated by arrow 66.

Figure 2C:
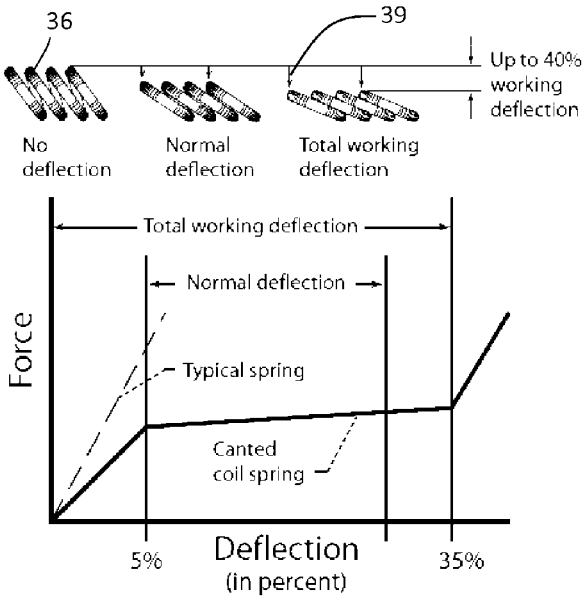
FIG. 2C shows a canted coil spring with deflection and a graph of force and deflection.
Figure 2D:
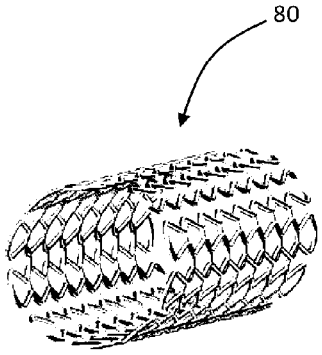
FIG. 2D shows an illustrative knitted spring tube.

Referring now to FIG. 2C there is shown side view of a canted coil spring 36 subject to deflection from an axial load. An axial canted coil spring has its compression force 39 parallel or axial to the centerline of the arc or ring. The graph of force vs. deflection shows the canted coil spring 36 being subjected to a range of compressive (axial) forces. As more force 39 is applied to the canted coil spring 36, the angle between the coils and the vertical axis increases. In the "normal deflection" range shown in FIG. 2C, the normal deflection indicates that the force produced by a canted coil spring 36 is nearly constant over a long range of deflection, especially when compared to a typical spring. This enables the cage 40 to "float" on the canted coil spring 36.

As described in further detail below, the canted coil spring 36 is installed within grooves in both the housing 20 and the cage 40. The canted coil spring may be designed according to the following illustrative parameters, namely, the wire material, the wire diameter, the cant amplitude, the coils per inch, the size controlled by spring width, and eccentricity. The cant amplitude is the axial distance the top coil is shifted compared to a helical spring. The eccentricity is a parameter that indicates a circular cross section; as the eccentricity increases the spring becomes more elliptical. Some manufacturers use other parameters to design a canted coil spring such as the front angle and the back angle instead of coils per inch and cant amplitude.

When a canted coil spring is deformed, the top of the coils slide against the contact surface and the bottom coils rotate about their axis. For example, the bottom of the spring is constrained axially so the coefficient of friction is greater at the contact between the spring and the bottom surface than the spring and the top surface; this process enables the cage to "float" on the canted coil spring.

Another illustrative seal preload device is a knitted spring tube shown in FIG. 2D. The knitted spring tube 80 includes a series of needles interwoven about a base helix. The needle pattern is defined by the combination of a circular section and a linear section, in which both sections are piecewise continuous and smooth at their intersection.

Other parameters to consider for designing canted coil springs and knitted spring tubes are provided in the thesis entitled MODELING OF CANTED COIL SPRINGS AND KNITTED SPRING TUBES AS HIGH TEMPERATURE SEAL PRELOAD DEVICES by Jay J. Oswald submitted in May 2005.

Figure 3A:
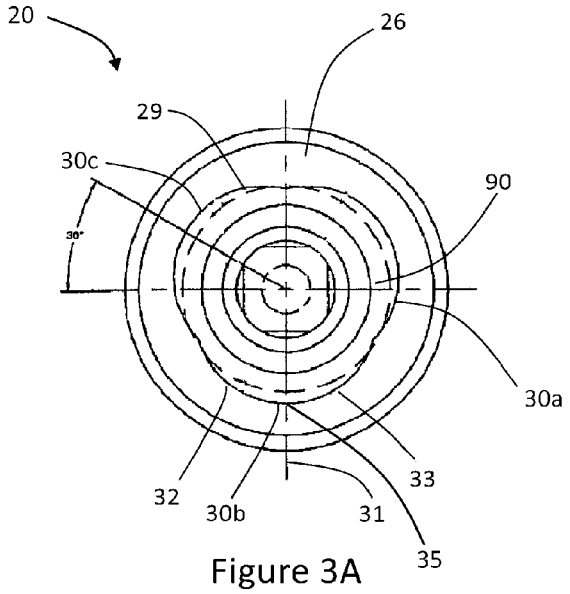
FIG. 3A shows a top view of the illustrative nut removal tool.

Referring now to FIG. 3A, there is shown an illustrative a top view of the housing 20 having a three-lobed cam. The housing includes a top surface 26, a lip 90 and a groove (not shown) that the canted coil spring 36 interfaces with. The interior sidewall 29 extends from the top surface 26 to the lip 90. The interior sidewall 29 also includes the three-lobed cam inner surfaces 30*a*, 30*b* and 30*c*.

By way of example and not of limitation, the cam inner surfaces 30*a*, 30*b* and 30*c* are equidistant from each other so that the arcs occupied by the cams are each approximately 120°. The three-lobed cam inner surfaces 30*a*, 30*b* and 30*c* are configured to interface with a cage, which interfaces with a nut. Each lobe has a lobe centerline such as lobe centerline 31. Additionally, each lobe has a counterclockwise cam inner surface 32 on one side of the lobe centerline, and a clockwise cam inner surface 33 on the opposite side of the lobe centerline.

The illustrative lobe centerlines are 120° apart from each other. The illustrative counterclockwise cam inner surface 32 has a 60° arc, and the clockwise cam inner surface 33 also has a 60° arc. The illustrative counterclockwise cam inner surface 32 has a clockwise cam inner surface 33 on each side. Additionally, each clockwise cam inner surface 33 has a counterclockwise cam inner face 32 adjacent to the clockwise cam inner surface 33. Each lobe has a distal portion 35 along the lobe centerline that is furthest from the center of the housing.

In the embodiment presented in FIG. 3A, the distance between the distal portion of the lobe and the center of the housing is greater than the semi-circular radius used to form the counterclockwise cam inner surface 32 and the clock cam inner surface 33. In the illustrative embodiment shown in FIG. 3A, the semi-circular radius used to form the counterclockwise cam inner surface 32 and the clockwise cam inner surface 33 share the same center radius. Alternatively, the semi-circular radius used to form the counterclockwise cam inner surface 32 and the clockwise cam inner surface 33 may each have different center radius.

In the illustrative embodiment of FIG. 3A, the illustrative three-lobed cam inner surface includes six different cam inner surfaces, in which three cam inner surfaces are clockwise cam surfaces and three cam inner surfaces are counterclockwise cam surfaces.

Generally, a counterclockwise force (to loosen the nut) is applied to the housing 20 for nut removal. This counterclockwise force is transferred to the cage 40, when the cage interfaces with the counterclockwise cam inner surface 32. There may be instances when nut removal requires the application of a clockwise force (tightening the nut), so the housing 20 is turned in a clockwise direction and this force is then transferred to the cage 40 with the clockwise cam inner surface 33. An illustrative impact wrench may be employed that has an operator controlled switch that can switch the direction of the force applied to the nut removal tool from counterclockwise to clockwise, and back to counterclockwise. By performing this operation of oscillating between the counterclockwise and clockwise directions, additional torque may be transferred to the nut to more effectively remove the nut.

The illustrative three-lobed cam inner surface 30 is symmetrical and is presented for illustrative purposes only. Alternatively, other symmetrical lobed cam assemblies may also be used such as a two-lobed cam, a four-lobed cam, five-lobed cam, etc. The number of lobes and configuration of each lobe will depend on the particular application.

Additionally, each lobe may have more than just two symmetrical cam surfaces (i.e. clockwise inner cam surface and counterclockwise inner cam surface). For example, each lobe may have three, four, five or six different cam inner surfaces that can interface with different cages or cartridges.

Furthermore, asymmetrical cam inner surfaces may also be employed. Thus, the lobed cam inner surface may have additional surfaces beyond just the symmetrical three-lobed cam surface presented herein. The inner cam surface may be asymmetrical and include a plurality of surfaces that can interface with a plurality of different cages.

Figure 3B:
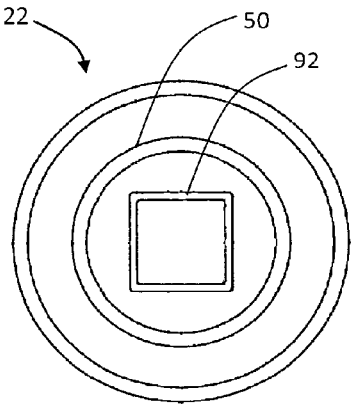
FIG. 3B shows a bottom view of the illustrative nut removal tool.

Referring now to FIG. 3B, there is shown an illustrative bottom view of the bottom surface 22. The rotary power tool is configured to slideably couple with the polygon shaped opening 92. Alternatively, a second canted coil spring may be used instead of the O-ring 50. The second canted coil spring can also absorb additional axial loading, thus enabling the cage to effectively grip the stud with minimal interference from the compressive forces emanating from the rotary power tool.

The illustrative rotary power tool may be an impact wrench (not shown) having an anvil (not shown) configured to be received by a polygon shaped opening 92 at the bottom end 22 of the nut tool 10. Alternatively, a hydraulic wench, pneumatic wrench or manual wrench may be used. Although the opening is shown as being square shaped, a circular or elliptical shaped opening may also be configured to match the shape of the rotary power tool.

An impact wrench is a power tool that delivers a high torque output by storing energy in a rotating mass and then delivering the energy to the output shaft. The power source for an impact wrench is generally compressed air. When a hammer, i.e. rotating mass, is accelerated by the power source and then connected to an anvil, i.e. output shaft, this creates the high-torque impact. When the hammer spins, the hammer's momentum is used to store kinetic energy that is then delivered to the anvil in a theoretically elastic collision having a very short impact force.

With an impact wrench, the only reaction force applied to the body of the tool is the motor accelerating the hammer, and thus the operator feels very little torque, even though a very high peak torque is delivered to the anvil. The impact wrench delivers rotational forces that can be switched between counterclockwise rotation and clockwise rotation. Additionally, the impact wrenches deliver oscillating compressive forces along the axis of the anvil of the impact wrench. Thus, when removing a nut, the anvil of the impact wrench is typically along a vertical axis and the impact wrench delivers oscillating compressive forces along the axis of the anvil, i.e. axial load, and rotational forces.

For the embodiments described herein, very large impact wrenches are used. These very large impact wrenches can deliver several hundred thousand foot-pounds of torque and are usually suspended from a crane or lift, since the impact wrenches are too heavy for a person to lift. Alternatively, other power tools besides impact wrenches are used to deliver high impact torque for nut removal, such as a regular drill or other such power tool.

Figure 4:
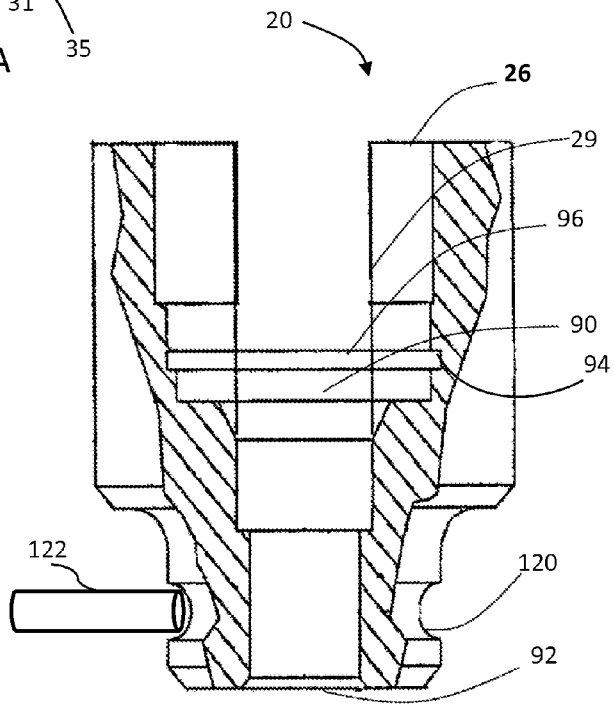
FIG. 4 shows a partial cross-sectional view of the nut removal tool without the cage.

Referring to FIG. 4 there is shown a cross-sectional view of the housing 20. The housing groove 96 of the interior sidewall 29 is configured to receive the canted coil spring 36 (not shown). The housing groove 96 extends around the inner perimeter of the housing 20. The groove 96 may include a shoulder 94 disposed below the interior sidewall 29.

The illustrative canted coil spring 36 may have the coils canted in either a clockwise or counterclockwise depending on the particular application and design constraints.

Figure 5:
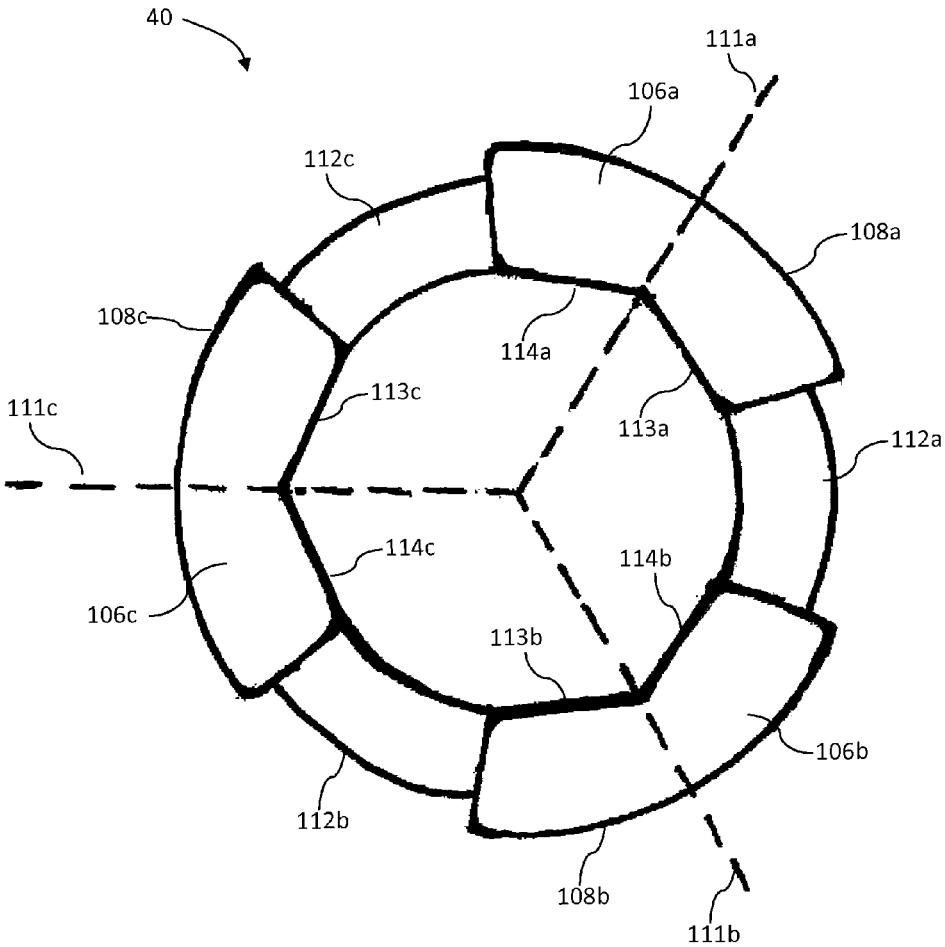
FIG. 5 shows a top view of an illustrative cage.
Figure 6:
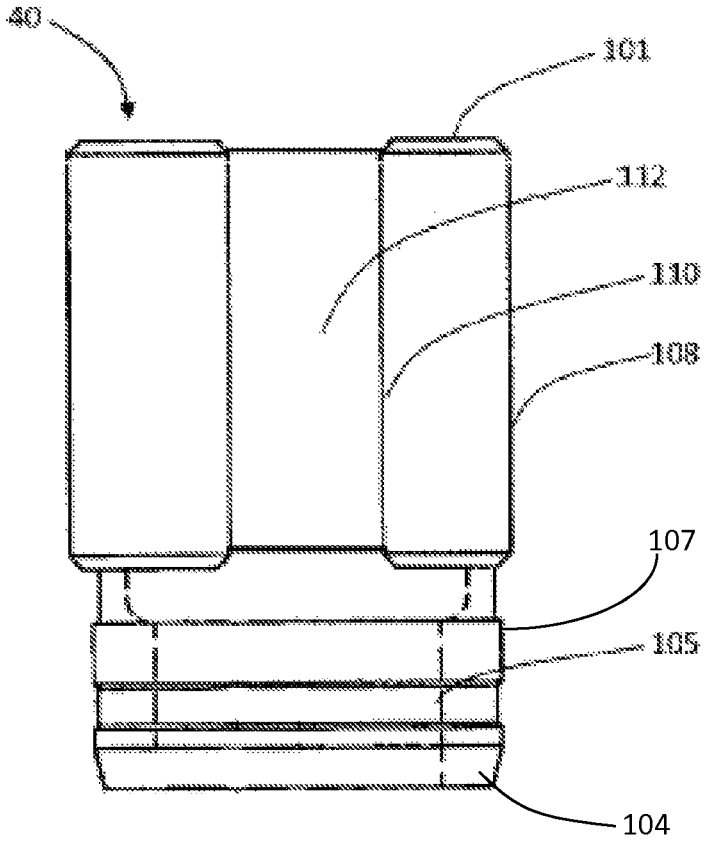
FIG. 6 shows a side view of the illustrative cage.

Referring to FIG. 5 and FIG. 6, there is shown a top view and side view of the illustrative cage 40, respectively. The cage 40 is configured to interface with the interior sidewall 29 and with the canted coil spring 36. The cage 40 has a top surface 101 and a bottom portion 107. The bottom portion 107 ends in a tapered terminus 104 configured to interface with the lip 90 of the housing 20. In a preferred embodiment, the bottom portion is a steel ring. Additionally, the cage 40 has a cage groove 105 that is configured to interface with the canted coil spring 36 (not shown).

The cage includes a plurality of jaws 106*a*, 106*b*, and 106*c*. Each of the jaws 106*a*, 106*b* and 106*c* includes a jaw outer cam surface 108*a*, 108*b*, and 108*c* and an inner cam surface respectively. Each jaw inner cam surface has a jaw centerline 111*a*, 111*b* and 111*c*, a counterclockwise cam inner surface 113*a*, 113*b* and 113*c* on one side of the jaw centerline, and a clockwise cam inner surface 114*a*, 114*b* and 114*c* on the opposite side of the jaw centerline. The jaw centerlines are 120° apart from each other. Thus, the illustrative three-jaw cam inner surfaces include six different cam inner surfaces, in which three cam inner surfaces are clockwise cam surfaces and three cam inner surfaces are counterclockwise cam surfaces.

Figure 8:
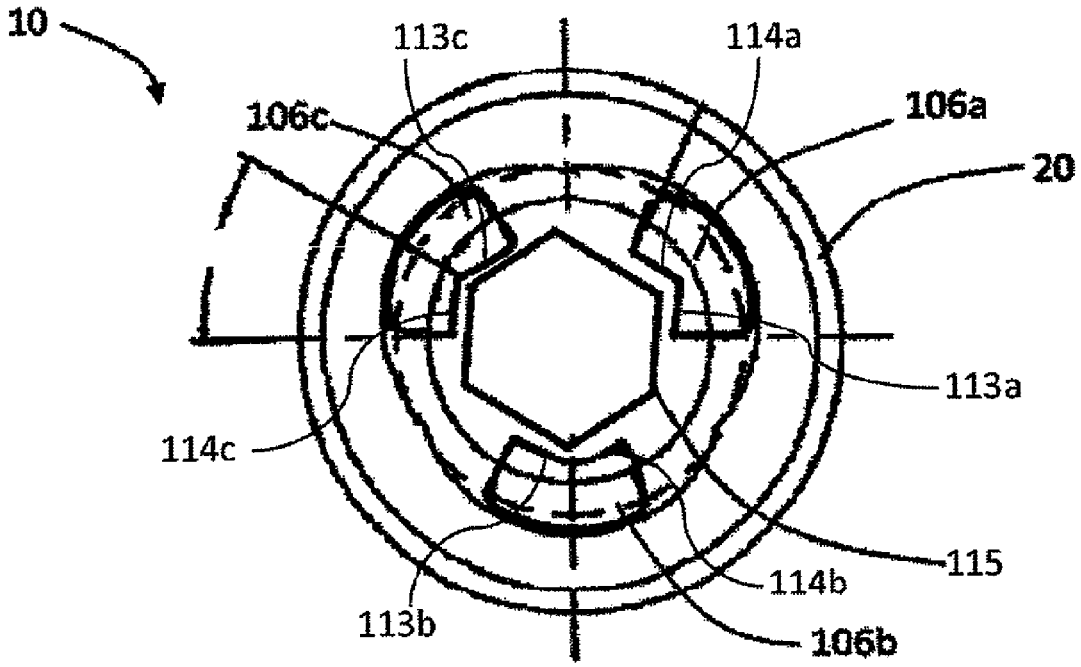
FIG. 8 shows a top view of the housing with the illustrative cage positioned within the housing. The jaws of the cage are shown in a first position with the jaws not contacting the nut.

The counterclockwise cam inner surface 113*a*, 113*b* and 113*c* on one side of the jaw centerline, and a clockwise cam inner surface 114*a*, 114*b* and 114*c* on the opposite side of the jaw centerline grip three corners of the illustrative hexagonal nut, as shown in FIG. 8. In the illustrative embodiment, each jaw outer cam surface 108 occupies a 60° arc. The jaw outer cam surface 108 is configured to interface with the cam inner surface 30 corresponding to the interior sidewall 29.

The illustrative cage 40 also includes an illustrative elastic webbing 112. The elastic webbing 112 is fixedly coupled to the jaws 106 and the bottom portion 107. Illustrative elastic webbing 112*a* joins jaws 106*a* and 106*b*. Also, elastic webbing 112*b* joins jaws 106*b* and 106*c*. Additionally, webbing 112*c* joins jaws 106*a* and 106*c*. The webbing 112 may also be embodied as an injection molded elastomeric cartridge or cage which holds the jaws 106 symmetrically apart, retaining the jaws 106 firmly against the surfaces of the housing cams.

By way of example and not of limitation, the elastomeric component configured to join the jaws has a durometer ranging from 20-40. In a narrower embodiment, the elastomeric material has a durometer of 30.

Generally, the webbing material is composed of an elastic material that can withstand operating conditions for nut removal. For example, the webbing matter may be composed of an elastic thermoplastic resin that is resistant to petroleum products. Also, other elastic or elastomeric materials, such as rubber or neoprene, may also be used.

Figure 7:
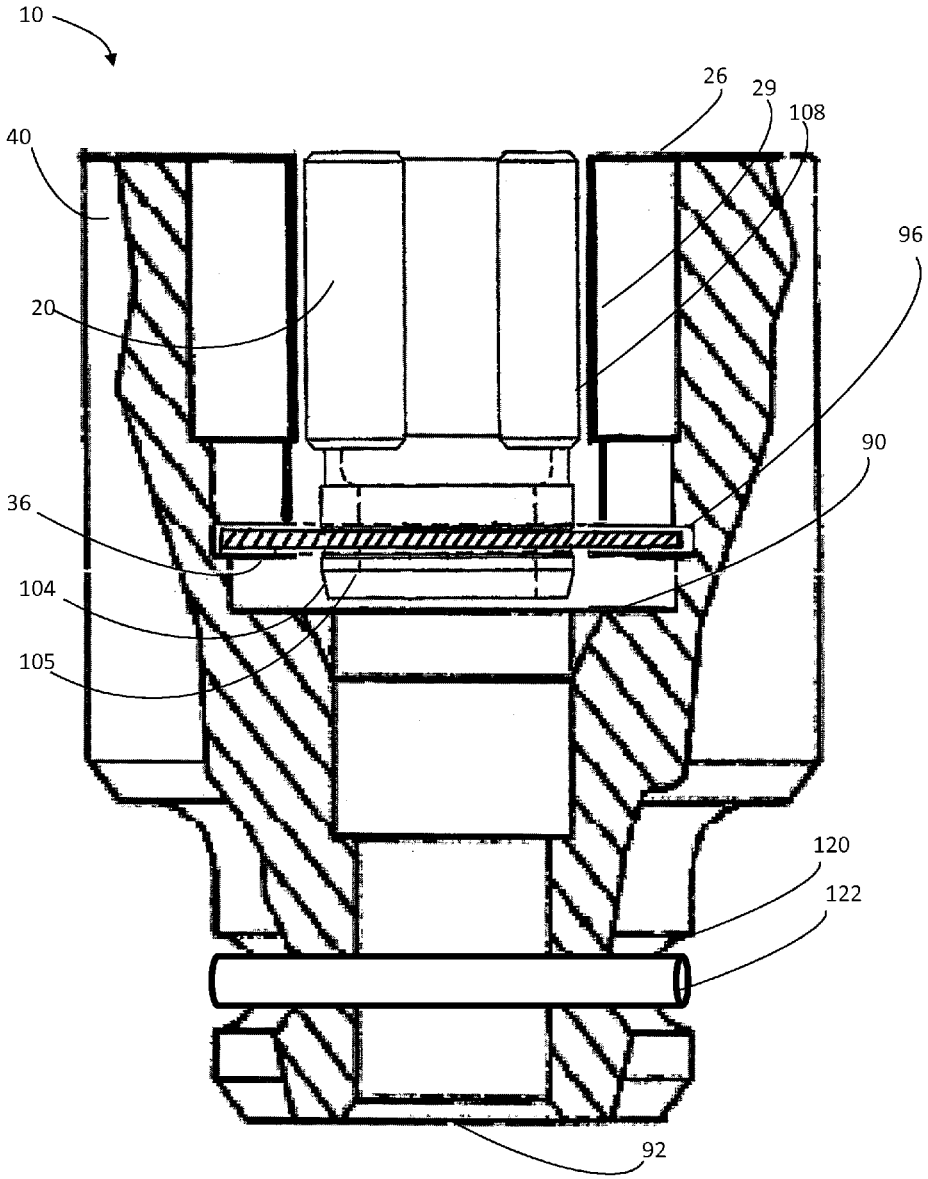
FIG. 7 shows a partial cross-sectional view of the nut removal tool with the cage and canted coil spring disposed inside the housing.

Referring now to FIG. 7, when inserted into the housing 20, the cage 40 slideably engages with the cam inner surfaces 30*a*, 30*b* and 30*c* (not shown) on the interior sidewall 29 of the housing 20. The tapered terminus 104 slides past the canted coil spring 36 fitted within the housing groove 96, and the canted coil spring 36 is received by a cage groove 105. When the canted coil spring 36 is secured within both the housing groove 96 and the cage groove 105, the cage tapered terminus 104 latches under the canted coil spring 36, holding the cage 40 in place within the housing 20. In FIG. 7, the pin 122 is shown inserted into the slot 120 of the housing 20 to hold a rotary impact tool (not shown) in place.

Referring now to FIG. 8 there is shown a sectional top view of the nut removal 10 with the cartridge 40 inside of the housing 20, and the jaws 106*a*, 106*b* and 106*c* interfacing with an illustrative hexagonal nut 115. The jaws 106*a*, 106*b* and 106*c* are shown in a resting position, in which no force is applied to the housing 20. In this resting position, the jaws 106 are not engaging the nut and the elastic webbing used to join the jaws causes the cams to return to the resting position, in which the jaw outer cam surface is configured to interface with the cam inner surface that is furthest from the illustrative hexagonal nut 115. Thus, in this resting position the nut removal tool is capable of accepting the nut before a rotational force is applied to the nut.

When a counterclockwise force is applied to the housing 20, this causes the housing 20 to shift approximately 30° to the left and the jaws are biased radially inwards by the cam. The housing 20 is rotated by a rotary power source, such as the air impact wrench described above, and the jaw outer cam surfaces 108*a*, 108*b* and 108*c* are configured to engage with the counterclockwise cam interface when a counterclockwise force is applied to the housing. When the jaws are biased radially inwards by the cam and the effective circumference of the cartridge is reduced, this causes the elastic webbing to flex (not shown). When the jaws are biased radially inwards, the jaw inner cam counterclockwise surface engages the nut.

When the housing is rotated counterclockwise, the jaw inner counterclockwise cam surfaces 113*a*, 113*b* and 113*c* engage three of the surfaces of the head of a hexagonal nut 115, rotating the nut counterclockwise for nut removal. When so engaged, each of the jaw inner counterclockwise cam surfaces 113 engage the surfaces of the head of the hexagonal nut 115 in a 30 degree arc. Thus, when engaged, the jaw inner counterclockwise cam surfaces 113 engage 25% of the flat surfaces of the hexagonal nut.

When the housing is rotated clockwise, the jaw inner clockwise cam surfaces 114*a*, 114*b* and 114*c* engage the other three surfaces of the head of a hexagonal nut 115, rotating the nut clockwise for tightening the nut. When so engaged, each of the jaw inner clockwise cam surfaces 114 engage the surfaces of the head of the hexagonal nut 115 in a 30 degree arc. Thus, when engaged, the jaw inner clockwise cam surfaces 114 engage 25% of the flat surfaces of the hexagonal nut.

The illustrative jaw inner cam surface 106 having three jaws is symmetrical and is presented for illustrative purposes only. Alternatively, other symmetrical jaw inner cam assemblies may also be used such as an assembly having two jaws, four jaws, five jaws, etc. The number of jaws and configuration of each jaw will depend on the particular application.

Additionally, each jaw may have more than just two symmetrical cam surfaces (i.e. clockwise inner cam surface and counterclockwise inner cam surface). For example, each jaw may have three, four, five or six different cam inner surfaces that can interface with different shaped nut heads.

Furthermore, asymmetrical jaw cam inner surfaces may also be employed. Thus, the jaw cam inner surface may have additional surfaces beyond just the symmetrical three-jaw cam surface presented herein. The jaw inner cam surface may be asymmetrical and include a plurality of surfaces that can interface with a plurality of different nut head shapes.

More specifically, the nut removal tool is configured to turn in a counterclockwise manner. This rotation causes the cam inner surfaces 30*a*, 30*b* and 30*c* of the housing 20 to apply force to the cam outer surfaces 108 of the cartridge 40 containing the jaws 106*a*, 106*b* and 106*c*. In operation, the deformation of the elastomer upon the application of torque allows for the jaw counterclockwise cam inner surface 113 and the jaw clockwise cam inner surface 114 to contact the nut 115 at multiple contact points.

Additionally, the jaw outer cam surface is configured to engage with the clockwise cam interface when a clockwise force is applied to the housing. During nut removal, the operator may increase the amount torque applied to the nut by toggling between applying a counterclockwise force and a clockwise force using the nut removal assembly described herein.

When inserted into the housing 20, the cage 40 slideably engages with the cam inner surfaces 30*a*, 30*b*, and 30*c* of the housing 20 (See FIG. 3A). The tapered terminus 104 slides past the canted coil spring 36 fitted within the housing groove 96, and the canted coil spring 36 is received by a cage groove 105. When the canted coil spring 36 is secured within both the housing groove 96 and the cage groove 105, the cage groove 105, the cage tapered terminus 104 latches under the canted coil spring 36, holding the cage 40 in place within the housing 20.

Figure 9:
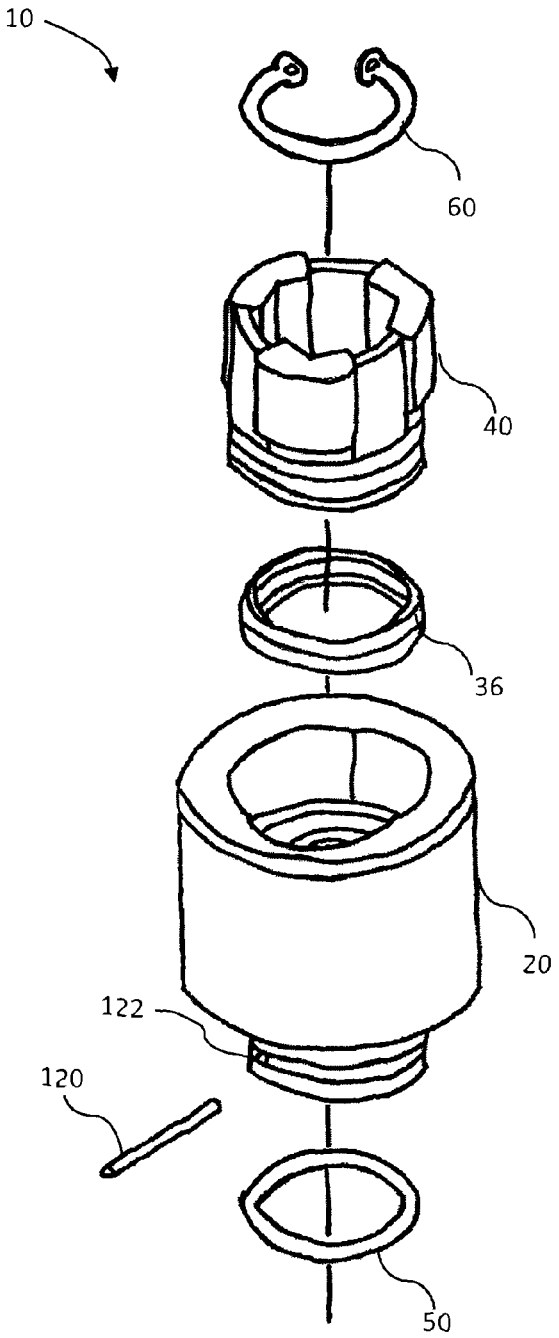
FIG. 9 shows an exploded isometric view of another illustrative nut removal tool, in which a retaining ring is used to hold the cage within the housing.

Referring to FIG. 9 there is shown an alternative embodiment of the nut removal tool 10, in which the cartridge 40 is also held in place within the housing 20 with an additional retaining ring 60. The retaining ring 60 can be used to keep the cage 40 from sliding out of the housing. Additionally, the retaining ring may also include a washer (not shown) that would be used to interface with the top surface of the cage 40.

The nut removal tool may have to remove very large nuts, e.g. a nut weighing two hundred pounds, and so the retaining ring 60 may be used in conjunction with the canted coil spring 36 to rotatably couple the housing 20 to the cage 40. Although a properly designed canted coil spring can be used to rotatably engage the cage to the housing, the maintenance of the nut removal tool would be quite challenging. The maintenance challenge is removed by having a heavy-duty canted coil spring that can lift a heavy nut, e.g. 200 lbs., and a cage 40. For the illustrative 200 lb nut, the expected canted coil spring would need to support an axial load of 300 lbs. and a 300 lbs. spring would be difficult for an operator to remove. A retaining ring 60 can be used to reduce the axial load on the canted coil spring and so for very large nuts, the operator that would be performing maintenance on the nut removal tool could, first, remove the retaining ring 60 that provides some axial support, second, remove the cage 40, and then remove the canted coil spring 36 that provides additional axial support.

Alternatively, the nut removal apparatus described above may not require a canted coil spring or other such seal preload device. Thus, the illustrative canted coil spring may simply be replaced with a retaining ring 60 described above. In addition to retaining ring 60 other fastening means may also be used.

Figure 10:
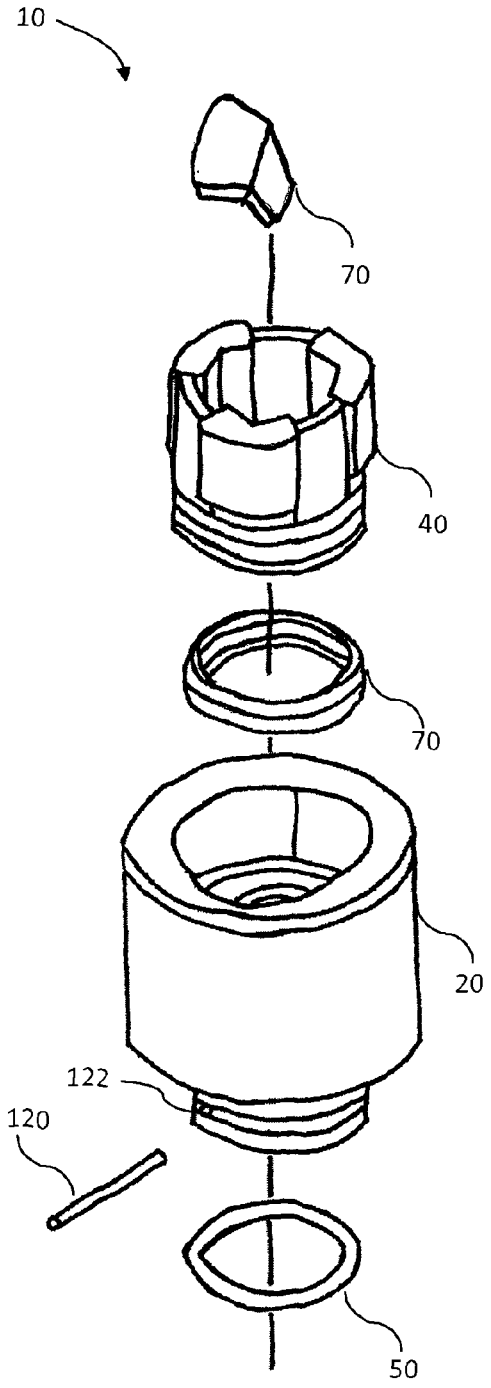
FIG. 10 shows an exploded isometric view of yet another illustrative nut removal tool, in which a clip is used to hold the cage within the housing.

For example, in FIG. 10 there is shown an alternative embodiment of the nut removal tool 10, in which the fastening means includes a clip 70. Other fastening means will readily suggest themselves to those of ordinary skill in the art. Generally, these fastening means may also be used that allow the cage 40 and the housing 20 to rotate freely in a counterclockwise or clockwise direction, while at the same time ensuring that the cage 40 does not slide out of the housing.

It is to be understood that the detailed description of illustrative embodiments provided for illustrative purposes. The scope of the claims is not limited to these specific embodiments or examples. Various structural limitations, elements, details, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. An apparatus for removing a nut, the apparatus comprising:

a housing, the housing includes, a top surface having an orifice that extends to a lip;

an interior sidewall that extends from the top surface to the lip, wherein the interior sidewall includes, a three-lobed cam disposed along the interior sidewall of the top end, wherein each lobe has a lobe center line and a counterclockwise cam inner surface on one side of the lobe center line and a clockwise cam inner surface on the opposite side of the lobe center line, a groove disposed between the top surface and the lip;

a bottom surface having an orifice that extends to the lip;

a cage having a top surface, a bottom portion ending in a tapered terminus and a groove in the bottom portion disposed between the top surface and the tapered terminus, the cage includes a plurality of jaws, in which each jaw includes, a jaw outer cam surface that is configured to interface with the cam inner surface corresponding to the interior sidewall;

a jaw centerline;

a jaw inner cam surface configured to interface with the head of the nut, each jaw cam inner surface includes a jaw counterclockwise cam inner surface on one side of the jaw centerline and a jaw clockwise cam inner surface on the opposite side of the jaw centerline;

a canted coil spring configured to be received by the groove of the interior sidewall and the groove of the cage;

the housing configured to rotate counterclockwise relative to the cage;

the cage configured to rotate counterclockwise and engage the nut, the cage configured to interface with the interior sidewall; and the canted coil spring configured to operate within a constant deflection range, when an axial load is applied by the housing and cage.

2. The apparatus of claim 1 wherein the canted coil spring has the coils canted in a clockwise direction.

3. The apparatus of claim 1 wherein the canted coil spring has the coils canted in a counterclockwise direction.

4. The apparatus of claim 1 wherein the lobe centerlines for each lobe are 120° apart, each lobe occupies a 120° arc, the counterclockwise cam interface has a 60° arc and the clockwise cam interface has a 60° arc.

5. The apparatus of claim 4 wherein each lobe is substantially semi-circular.

6. The apparatus of claim 5 wherein each jaw outer cam surface occupies a 60° arc.

7. The apparatus of claim 6 wherein the jaw outer cam surface is configured to engage with the counterclockwise cam interface when a counterclockwise force is applied to the housing.

8. The apparatus of claim 7 wherein the jaw outer cam surface is configured to engage with the clockwise cam interface when a clockwise force is applied to the housing.

9. The apparatus of claim 1 further comprising an elastomeric component configured to join the plurality of jaws.

10. The apparatus of claim 1 wherein the bottom end is configured to interface with an impact rotary tool that can oscillate between applying a counterclockwise force and a clockwise force.

11. The apparatus of claim 10 wherein the bottom end further comprises a slot configured to receive a pin that is inserted within the slot when the housing is configured to interface with the impact rotary tool.

12. An apparatus for removing a nut, the apparatus comprising:

a housing, the housing includes, a top surface having an orifice that extends to a lip;

an interior sidewall that extends from the top surface to the lip, wherein the interior sidewall includes, a lobed cam disposed along the interior sidewall of the top end, wherein each lobe has a lobe center line and a counterclockwise cam inner surface on one side of the lobe center line and a clockwise cam inner surface on the opposite side of the lobe center line, a groove disposed between the top surface and the lip;

a bottom surface having an orifice that extends to the lip;

a cage having a top surface, a bottom portion ending in a tapered terminus and a groove in the bottom portion disposed between the top surface and the tapered terminus, the cage includes a plurality of jaws, in which each jaw includes, a jaw outer cam surface that is configured to interface with the cam inner surface corresponding to the interior sidewall;

a jaw centerline;

a jaw inner cam surface configured to interface with the head of the nut, each jaw inner cam surface includes a jaw counterclockwise cam inner surface on one side of the jaw centerline and a jaw clockwise cam inner surface on the opposite side of the jaw centerline;

a canted coil spring configured to be received by the groove of the interior sidewall and the groove of the cage;

the housing configured to rotate counterclockwise relative to the cage; and the cage configured to rotate counterclockwise and engage the nut, the cage configured to interface with the interior sidewall.

13. The apparatus of claim 12 wherein the canted coil spring has coils canted in a clockwise direction.

14. The apparatus of claim 12 wherein the canted coil spring has coils canted in a counterclockwise direction.

15. The apparatus of claim 12 wherein each lobe is substantially semi-circular.

16. The apparatus of claim 15 wherein the jaw outer cam surface is configured to engage with the counterclockwise cam interface when a counterclockwise force is applied to the housing.

17. The apparatus of claim 16 wherein the jaw outer cam surface is configured to engage with the clockwise cam interface when a clockwise force is applied to the housing.

18. The apparatus of claim 12 further comprising an elastic component configured to join the plurality of jaws.

19. The apparatus of claim 12 wherein the bottom end is configured to interface with an impact rotary tool that can oscillate between applying a counterclockwise force and a clockwise force.

20. The apparatus of claim 19 wherein the bottom end further comprises a slot configured to receive a pin that is inserted within the slot when the housing is configured to interface with the impact rotary tool.

21. An apparatus for removing a nut, the apparatus comprising:

a housing, the housing includes, a top surface having an orifice that extends to a lip;

an interior sidewall that extends from the top surface to the lip, wherein the interior sidewall includes, a three-lobed cam disposed along the interior sidewall of the top end, wherein each lobe has a lobe center line and a counterclockwise cam inner surface on one side of the lobe center line and a clockwise cam inner surface on the opposite side of the lobe center line, a groove disposed between the top surface and the lip;

a bottom surface having an orifice that extends to the lip;

a cage having a top surface, a bottom portion ending in a tapered terminus and a groove in the bottom portion disposed between the top surface and the tapered terminus, the cage includes a plurality of jaws, in which each jaw includes, a jaw outer cam surface that is configured to interface with the cam inner surface corresponding to the interior sidewall;

a jaw centerline;

a jaw inner cam surface configured to interface with the head of the nut, each jaw inner cam surface includes a jaw counterclockwise cam inner surface on one side of the jaw centerline and a jaw clockwise cam inner surface on the opposite side of the jaw centerline;

a means for fastening the cage, which is rotatably coupled to the housing;

the housing configured to rotate counterclockwise relative to the cage, the cage configured to rotate counterclockwise and engage the nut, wherein the cage is configured to interface with the interior sidewall.

22. The apparatus of claim 21 wherein the lobe centerlines for each lobe are 120° apart, each lobe occupies a 120° arc, the counterclockwise cam interface has a 60° arc and the clockwise cam interface has a 60° arc.

23. The apparatus of claim 22 wherein each lobe is substantially semi-circular.

24. The apparatus of claim 23 wherein the jaw outer cam surface is configured to engage with the counterclockwise cam interface when a counterclockwise force is applied to the housing.

25. The apparatus of claim 24 wherein jaw outer cam surface is configured to engage with the clockwise cam interface when a clockwise force is applied to the housing.

26. The apparatus of claim 21 further comprising an elastomeric component configured to join the plurality of jaws.

27. The apparatus of claim 21 wherein the bottom end is configured to interface with an impact rotary tool that can oscillate between applying a counterclockwise force and a clockwise force.

28. The apparatus of claim 27 wherein the bottom end further comprises a slot configured to receive a pin that is inserted within the slot when the housing is configured to interface with the impact rotary tool.

29. The apparatus of claim 21 wherein the means for fastening the cage within the housing is a retaining ring.

30. The apparatus of claim 21 wherein the means for fastening the cage within the housing is a clip.

* * * * *